US009815071B2

(12) United States Patent
Posner et al.

(10) Patent No.: US 9,815,071 B2
(45) Date of Patent: Nov. 14, 2017

(54) HOUSING FOR A NOZZLE

(71) Applicant: Dust Solutions Inc., Beaufort, SC (US)

(72) Inventors: Richard Posner, Bluffton, SC (US); Craig Strickland, Beaufort, SC (US); Daniel Zoran, Beaufort, SC (US); Glen Warrington, Fort Meyers, FL (US)

(73) Assignee: Dust Solutions, Inc., Beaufort, SC (US)

( * ) Notice: Subject to any disclaimer, the term of this patent is extended or adjusted under 35 U.S.C. 154(b) by 0 days.

(21) Appl. No.: 15/133,445

(22) Filed: Apr. 20, 2016

(65) Prior Publication Data

US 2016/0303591 A1 Oct. 20, 2016

Related U.S. Application Data

(60) Provisional application No. 62/150,033, filed on Apr. 20, 2015.

(51) Int. Cl.
*A62C 5/02* (2006.01)
*B05B 1/32* (2006.01)
(Continued)

(52) U.S. Cl.
CPC ..... *B05B 1/323* (2013.01); *B05B 1/3046* (2013.01); *B05B 7/04* (2013.01); *B05B 7/0483* (2013.01); *B05B 7/0815* (2013.01); *B05B 15/001* (2013.01); *B05B 15/02* (2013.01); *B05B 15/0208* (2013.01); *B05B 15/0291* (2013.01); *B05B 15/10* (2013.01); *B05B 17/06* (2013.01); *B05B 17/0607* (2013.01);
(Continued)

(58) Field of Classification Search
CPC ... B05B 1/323; B05B 7/04833; B05B 15/001; B05B 15/02; B05B 15/0208; B05B 15/10; B05B 1/00; B05B 17/0646; B05B 17/06; B05B 17/0607; B05B 7/04; B05B 7/0815; B05B 15/029; B05B 1/3046; Y10S 239/12; Y10S 239/19; E21F 5/00; E21F 5/02; E21F 5/04; E21F 5/06
USPC ..... 239/1, 4, 8, 102.1, 102.2, 288–288.5, 239/418, 419, 433, 452, 453, 533.1, 239/533.13, 583, 602, DIG. 19; 169/64
See application file for complete search history.

(56) References Cited

U.S. PATENT DOCUMENTS 3,412,936 A * 11/1968 Angelinetta ..... B01D 35/00 239/453
4,541,564 A * 9/1985 Berger ..... B05B 17/0623 239/102.2
(Continued)

*Primary Examiner* — Steven J Ganey
(74) *Attorney, Agent, or Firm* — Baker & Hostetler LLP

(57) ABSTRACT

A housing selectively encloses a nozzle. The housing has a body that partially defines an interior space in which the nozzle is configured to be disposed. The housing also includes a cover assembly that selectively blocks a first aperture of the body and further defines the interior space. Additionally, the housing has a piston that is disposed in the interior space and secured to the nozzle. The piston defines a gas inlet, a liquid inlet, and an outlet fluidly connected to both the gas inlet and the liquid inlet. The housing further includes a biasing member attached to the piston. The biasing member is configured to exert a biasing force that biases the nozzle to a retracted position. The biasing member is further configured such that when pressurized gas flows through the body, the biasing force is overcome such that the nozzle is disposed in an extended position.

20 Claims, 8 Drawing Sheets

(51) Int. Cl.

| | |
|---|---|
| ***B05B 15/02*** | (2006.01) |
| ***B05B 17/00*** | (2006.01) |
| ***B05B 17/06*** | (2006.01) |
| ***B05B 7/08*** | (2006.01) |
| ***B05B 1/30*** | (2006.01) |
| ***B05B 7/04*** | (2006.01) |
| ***E21F 5/00*** | (2006.01) |
| ***B05B 15/00*** | (2006.01) |
| ***B05B 15/10*** | (2006.01) |

(52) U.S. Cl.
CPC ..... *B05B 17/0646* (2013.01); *E21F 5/00* (2013.01); *Y10S 239/19* (2013.01)

(56) References Cited

U.S. PATENT DOCUMENTS 4,655,393 A * 4/1987 Berger ..... B05B 17/0623 239/102.1
9,010,664 B2 * 4/2015 Combs ..... A62C 31/03 239/533.1

* cited by examiner

HOUSING FOR A NOZZLE

CROSS-REFERENCE TO RELATED APPLICATIONS

This application claims the benefit of U.S. Patent Application Ser. No. 62/150,033 filed Apr. 20, 2015, the disclosure of which is hereby incorporated by reference as if set forth in its entirety herein.

TECHNICAL FIELD

This disclosure relates generally to fog-type dust suppression systems and, more particularly, to a housing for a nozzle used in such dust suppression systems.

BACKGROUND

Fog-type dust suppression systems typically use a pneumatic nozzle that mixes air and water to create a fog. This fog may be used to agglomerate and remove airborne dust particles from various material handling and processing operations at a variety of material handling points. For example, these systems may be configured for use in truck dumps, rail dumps, reclaim tunnels, crushers, screens, stack outs, ship loaders, truck loading silos and conveyor transfer points.

Some fog-type dust suppression systems utilize water and compressed air to produce a dry fog that has droplets smaller than 10 μm in size. One type of pneumatic nozzle for creating this dry fog is an ultrasonic atomizing nozzle that has convergent/divergent venturi. This convergent/divergent venturi is configured to create a standing shockwave that atomizes the incoming water into ultra-fine water droplets. These droplets agglomerate to like size dust particles or particulate matter 10 μm or smaller. The slightly wetted dust particles then become heavy enough to be removed from the air and fall back into the process.

SUMMARY

Nozzles of fog-type dust suppression systems are often exposed to their operating environments. During operation, such exposure typically does not result in dust build-up on the nozzle because the suppression system itself creates sufficient vibration to be self-cleaning. Flow of air from the nozzle tip further provides further self-cleaning. However, when these suppression systems are not operating the nozzle may be subject to build-up through exposure to its operating environment. Because of the complex geometry of the nozzle, such build-up may be difficult to clean and may also impede proper operation of the system.

According to an aspect of the disclosure, a pneumatic assembly includes a nozzle and a housing. The housing selectively encloses the nozzle. The housing has a body that includes a first end and a second end opposite the first end. The body partially defines an interior space in which the nozzle is configured to be disposed. The body further defines a first aperture at the first end and a second aperture at the second end. The body is elongate along an axis that extends through both the first aperture and the second aperture. The housing also includes a cover assembly that is coupled to the first end of the body. The cover assembly selectively blocks the first aperture and further defines the interior space. Additionally, the housing has a piston that is disposed in the interior space and secured to the nozzle. The piston defines a gas inlet, a liquid inlet, and an outlet fluidly connected to both the gas inlet and the liquid inlet. The housing further includes a biasing member attached to the piston. The biasing member is configured to exert a biasing force on the piston in a first direction parallel to the axis. This biasing force biases the nozzle to a retracted position in which the nozzle is entirely disposed within the interior space. The biasing member is further configured such that when pressurized gas flows through the second aperture of the body, the biasing force on the piston is overcome. When the biasing force is overcome, the piston moves in a second direction opposite the first direction to dispose the nozzle in an extended position. In the extended position, at least a portion of the nozzle extends past the cover assembly and is positioned outside the interior space.

According to another aspect of the disclosure, a housing for a pneumatic nozzle has a body. The body includes a first end and a second end opposite the first end. The body partially defines an interior space in which the nozzle is configured to be disposed. The body further defines a first aperture at the first end and a second aperture at the second end. The body is elongate along an axis that extends through both the first aperture and the second aperture. The housing also includes a cover assembly that is coupled to the first end of the body. The cover assembly selectively blocks the first aperture and further defines the interior space. Additionally, the housing has a piston that is disposed in the interior space and secured to the nozzle. The piston defines a gas inlet, a liquid inlet, and an outlet fluidly connected to both the gas inlet and the liquid inlet. The housing further includes a biasing member attached to the piston. The biasing member is configured to exert a biasing force on the piston in a first direction parallel to the axis. This biasing force biases the nozzle to a retracted position in which the nozzle is entirely disposed within the interior space. The biasing member is further configured such that when pressurized gas flows through the second aperture of the body, the biasing force on the piston is overcome. When the biasing force is overcome, the piston moves in a second direction opposite the first direction to dispose the nozzle in an extended position. In the extended position, at least a portion of the nozzle extends past the cover assembly and is positioned outside the interior space.

According to a third aspect of the disclosure, a method for protecting a pneumatic nozzle during non-operational periods uses a housing configured to protect the pneumatic nozzle. The housing includes a body having a first end and a second end opposite the first end. The body partially defines an interior space in which the nozzle is configured to be disposed. The body further defines a first aperture at the first end, and a second aperture at the second end. The body is elongate along an axis that extends through both the first aperture and the second aperture. The housing also includes a cover assembly coupled to the first end of the body. The cover assembly selectively blocks the first aperture and further defines the interior space. Additionally, the housing includes a piston disposed in the interior space and secured to the pneumatic nozzle. Further, the housing includes a biasing member attached to the piston. The method includes a step of exerting a biasing force on the piston in a first direction parallel to the axis so as to bias the nozzle to a retracted position in which the nozzle is entirely disposed within the interior space. The method also includes a step of overcoming the biasing force on the piston by flowing pressurized gas through the second aperture of the body. Further, the method includes a step of moving the piston in a second direction opposite the first direction to dispose the nozzle in an extended position in which at least a portion of the nozzle extends past the cover assembly and is positioned outside the interior space.

BRIEF DESCRIPTION OF THE DRAWINGS

The foregoing summary, as well as the following detailed description of illustrative embodiments of the housing for a nozzle of the present application, will be better understood when read in conjunction with the appended drawings. For the purposes of illustrating the housing for a nozzle of the present application, there is shown in the drawings illustrative embodiments. It should be understood, however, that the application is not limited to the precise arrangements and instrumentalities shown. In the drawings.

DETAILED DESCRIPTION OF THE ILLUSTRATIVE EMBODIMENTS

Aspects of the disclosure will now be described in detail with reference to the drawings, wherein like reference numbers refer to like elements throughout, unless specified otherwise. Certain terminology is used in the following description for convenience only and is not limiting.

Figures 1A, 1B:
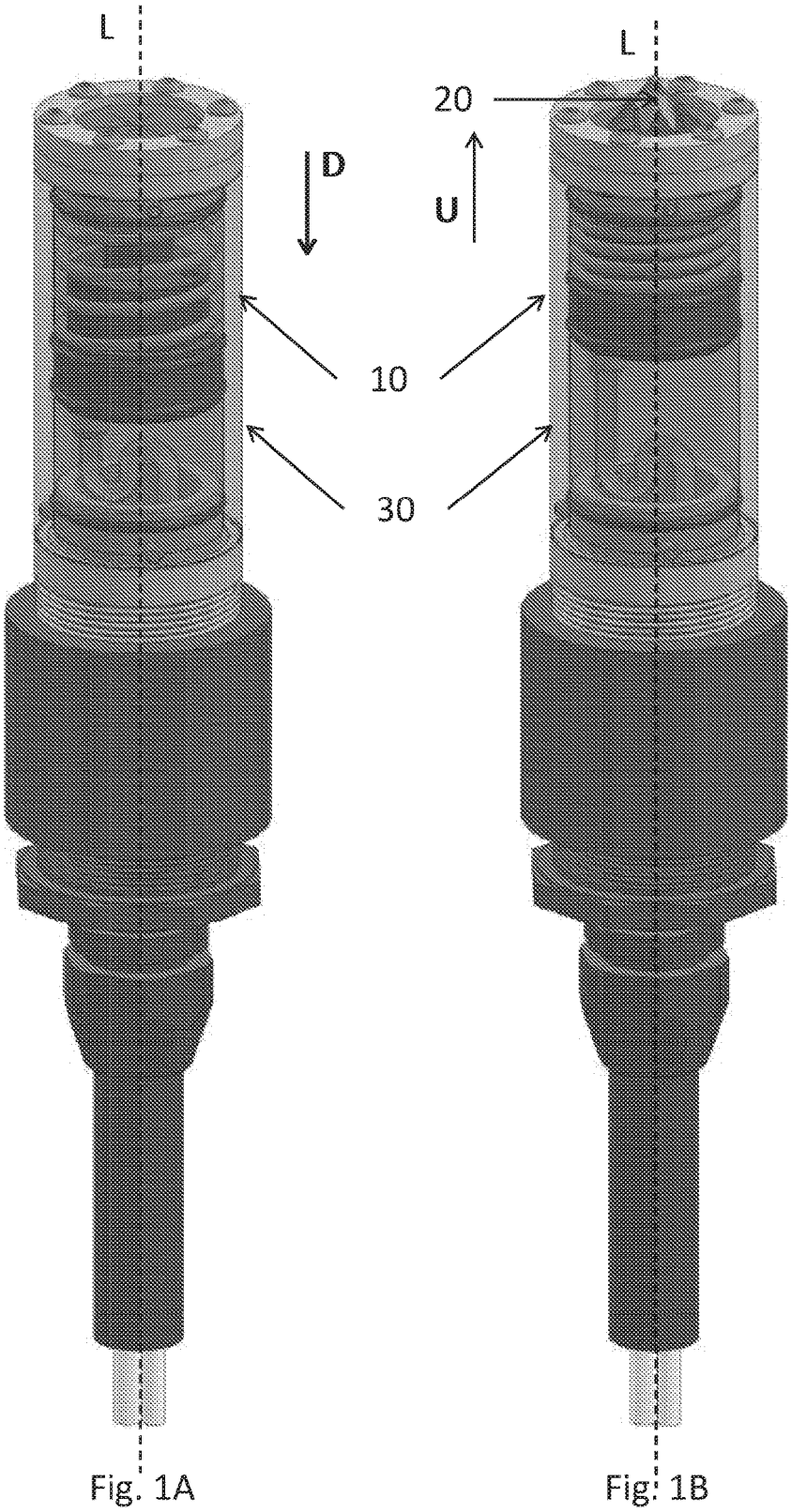
FIG. 1A is a perspective view of a housing for a nozzle with the nozzle in a retracted position and attached to a piston.
FIG. 1B is a perspective view of the housing shown in FIG. 1A with the nozzle in an extended position.
Figure 5A:
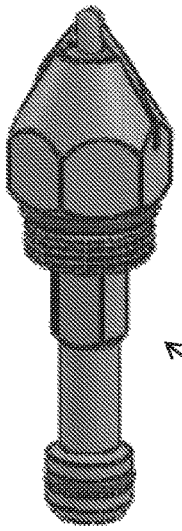
FIG. 5A is a perspective view of the piston shown in FIGS. 1A-3.
Figure 5B:
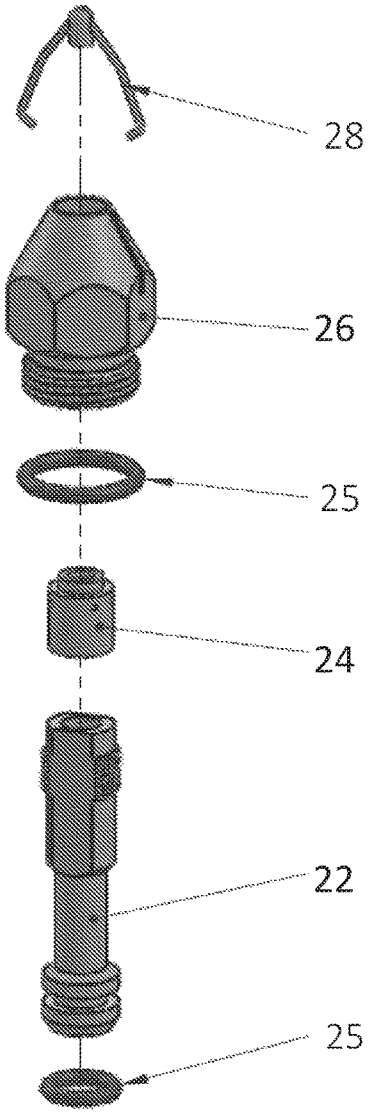
FIG. 5B is an exploded view of the piston shown in FIGS. 1A-3 and 5A.
Figures 7A, 7B:
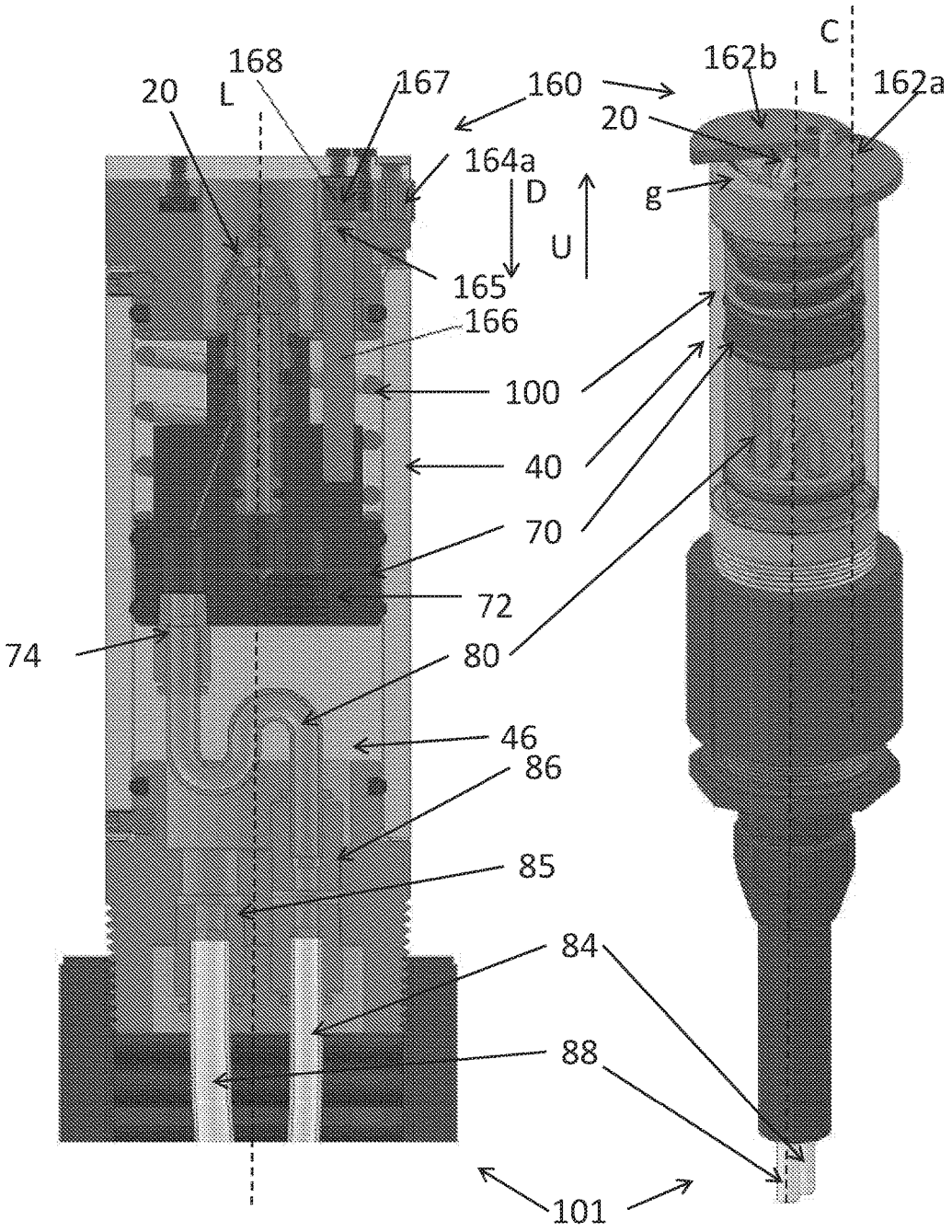
FIG. 7A is a cross sectional view of a another housing for the nozzle with the nozzle in a retracted position.
FIG. 7B is a perspective view of the housing shown in FIG. 7A with the nozzle in the extended position.
Figure 8A:
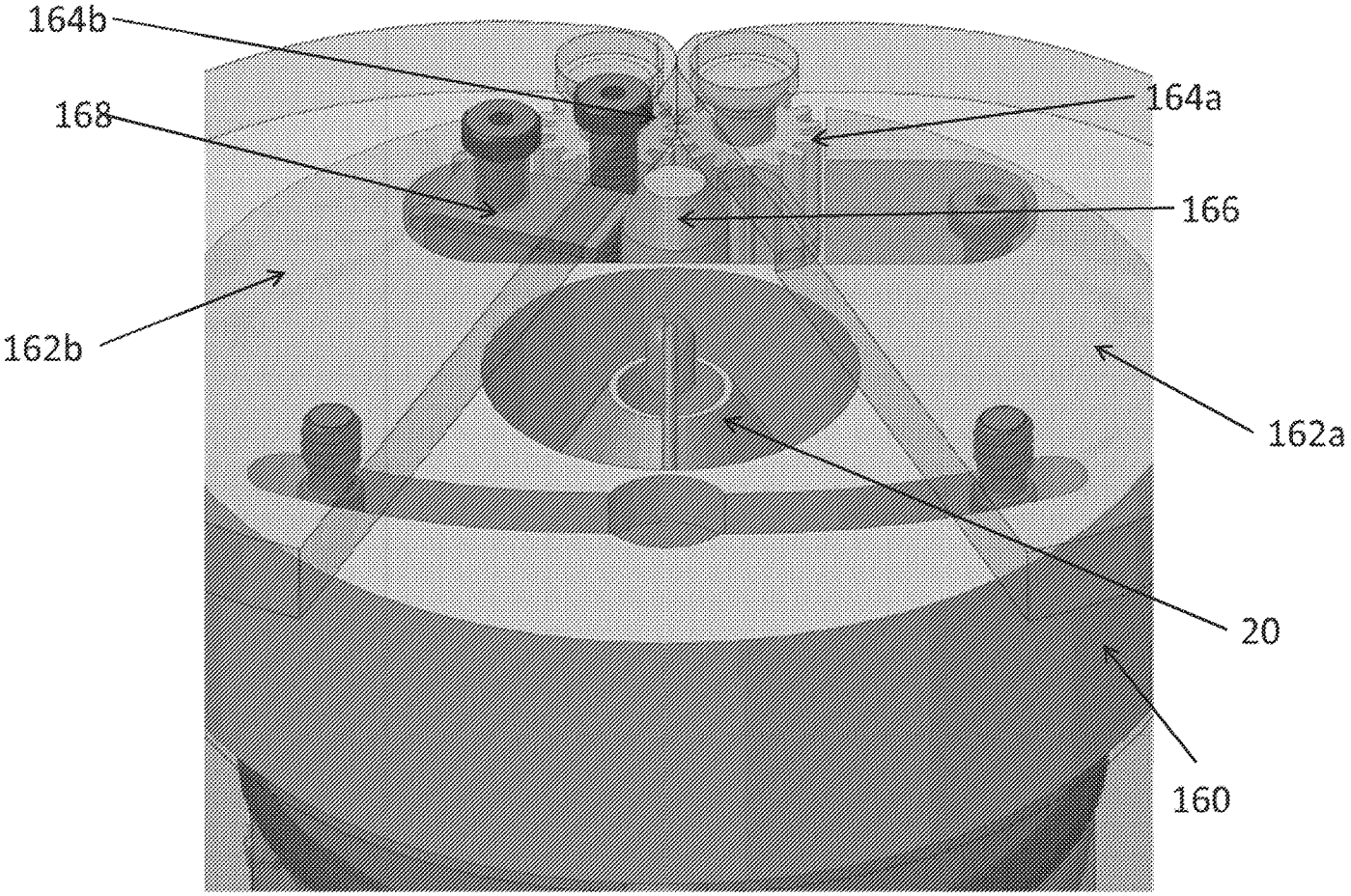
FIG. 8A is a front perspective view of a portion of the housing shown in FIGS. 7A and 7B with the nozzle disposed partially between the retracted position and the extended position.
Figure 8B:
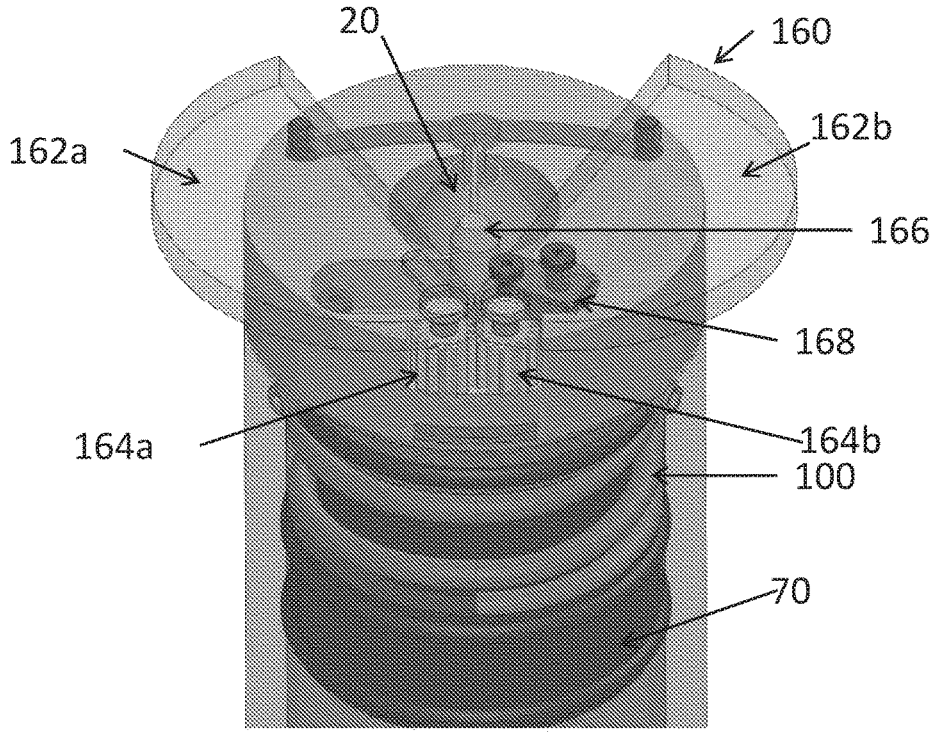
FIG. 8B is a rear perspective view of a portion of the housing shown in FIGS. 7A-8A with the nozzle disposed partially between the retracted position and the extended position.
Figure 8C:
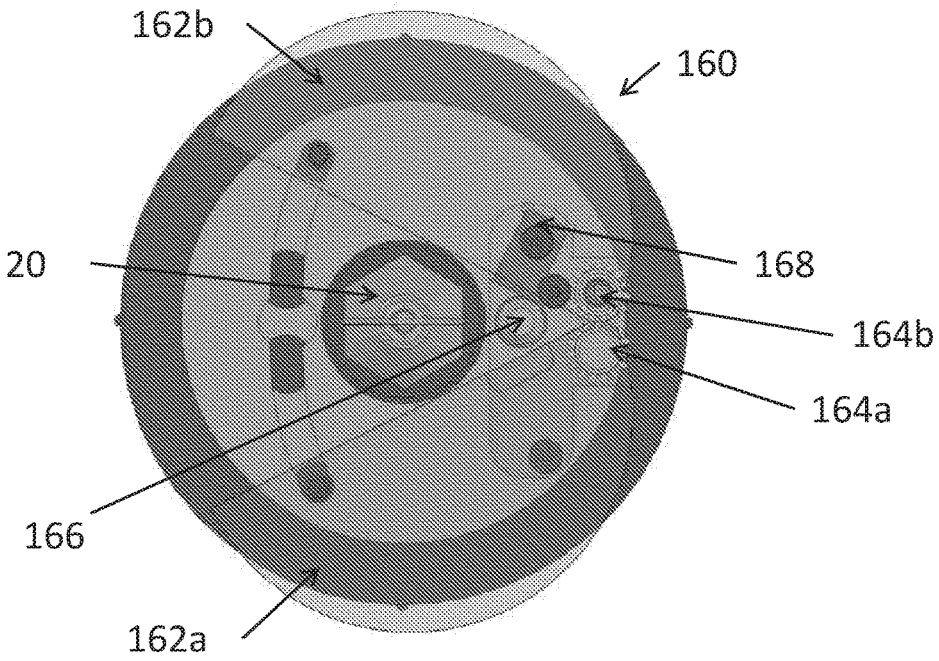
FIG. 8C is a top plan view of the housing shown in FIGS. 7A-8B with the nozzle disposed partially between the retracted position and the extended position.

Referring to FIGS. 1A and 1B, a pneumatic assembly 10 includes a nozzle 20 and a housing 30. The housing 30 selectively encloses the nozzle 20. Specifically, FIG. 1A depicts the nozzle 20 in a retracted position wherein nozzle 20 is disposed within housing 30. FIG. 1B depicts nozzle 20 in an extended position wherein nozzle 20 extends outside of housing 30. As shown in FIGS. 5A and 5B, nozzle 20 includes a shaft 22 that is in fluid communication with an inner body 24, which in turn is in fluid communication with outer body 26. A resonator 28 may be secured to outer body 26. For example, resonator 28 may snap-fit onto outer body 26. O-rings 25 may be used to seal connections within the nozzle 20 and throughout the assembly 10. Nozzle 20 may be a pneumatic nozzle, such as an ultrasonic atomizing nozzle.

Figure 2:
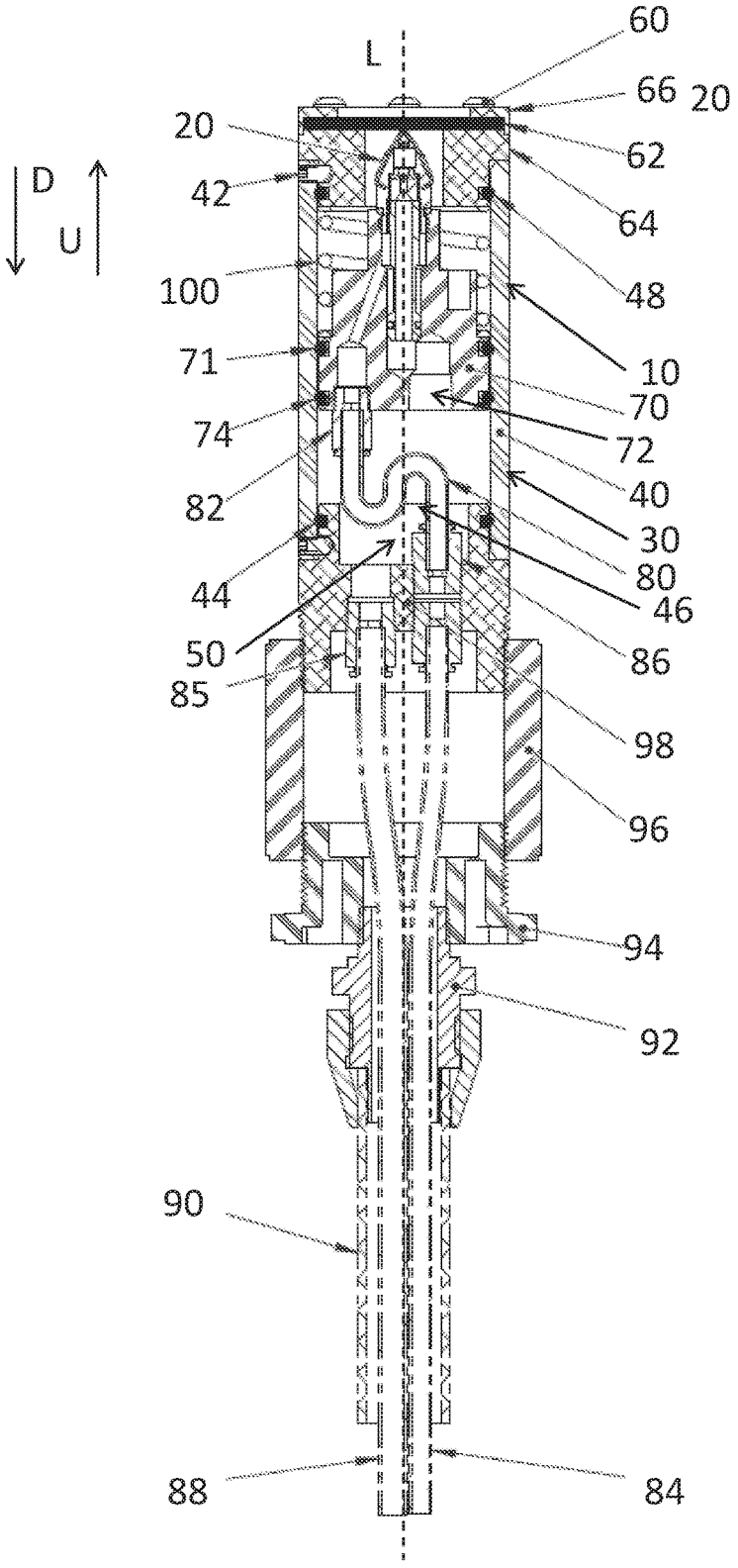
FIG. 2 is a cross sectional view of the housing shown in FIGS. 1A and 1B with the nozzle in the retracted position.

With reference to FIG. 2, the housing 30 has a body 40 that includes a first end 42 and a second end 44 opposite the first end 42. The body 40 partially defines an interior space 46 in which the nozzle 20 is configured to be disposed. The body 40 further defines a first aperture 48 at the first end 42 and a second aperture 50 at the second end 44. The body 40 is elongate along an axis L that extends through both the first aperture 48 and the second aperture 50.

Figure 6:
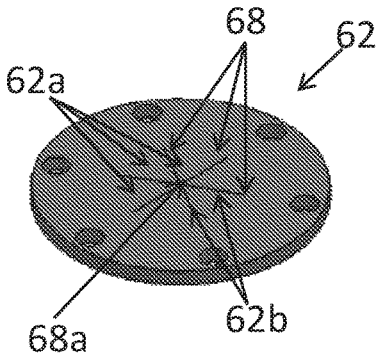
FIG. 6 is a perspective view of the cover shown in FIGS. 1A-3.

The housing also includes a cover assembly 60 that is coupled to the first end 42 of the body 40. The cover assembly 60 selectively blocks the first aperture 48 and further defines the interior space 46. Cover assembly 60 may include a cover 62 that is secured between a cap 64 and a ring 66. Ring 66 and to cap 64 may be screwed together by screws 65 so as to form a clamp around cover 62. With reference to FIG. 6, cover 62 may be formed of a flexible material such as rubber. Cover 62 may define at least one slit 68, such as three slits 68 that intersect at a centerpoint 68*a*. Slits 68 may be configured such that portions 62*a* of the cover 62 can flex away from centerpoint 68*a* as nozzle 20 protrudes through the cover 62. Further, edges 62*b* formed by and proximate to slits 68 may be configured to scrap against nozzle 20 as it retracts through cover 62, thereby cleaning the nozzle 20.

Figure 3:
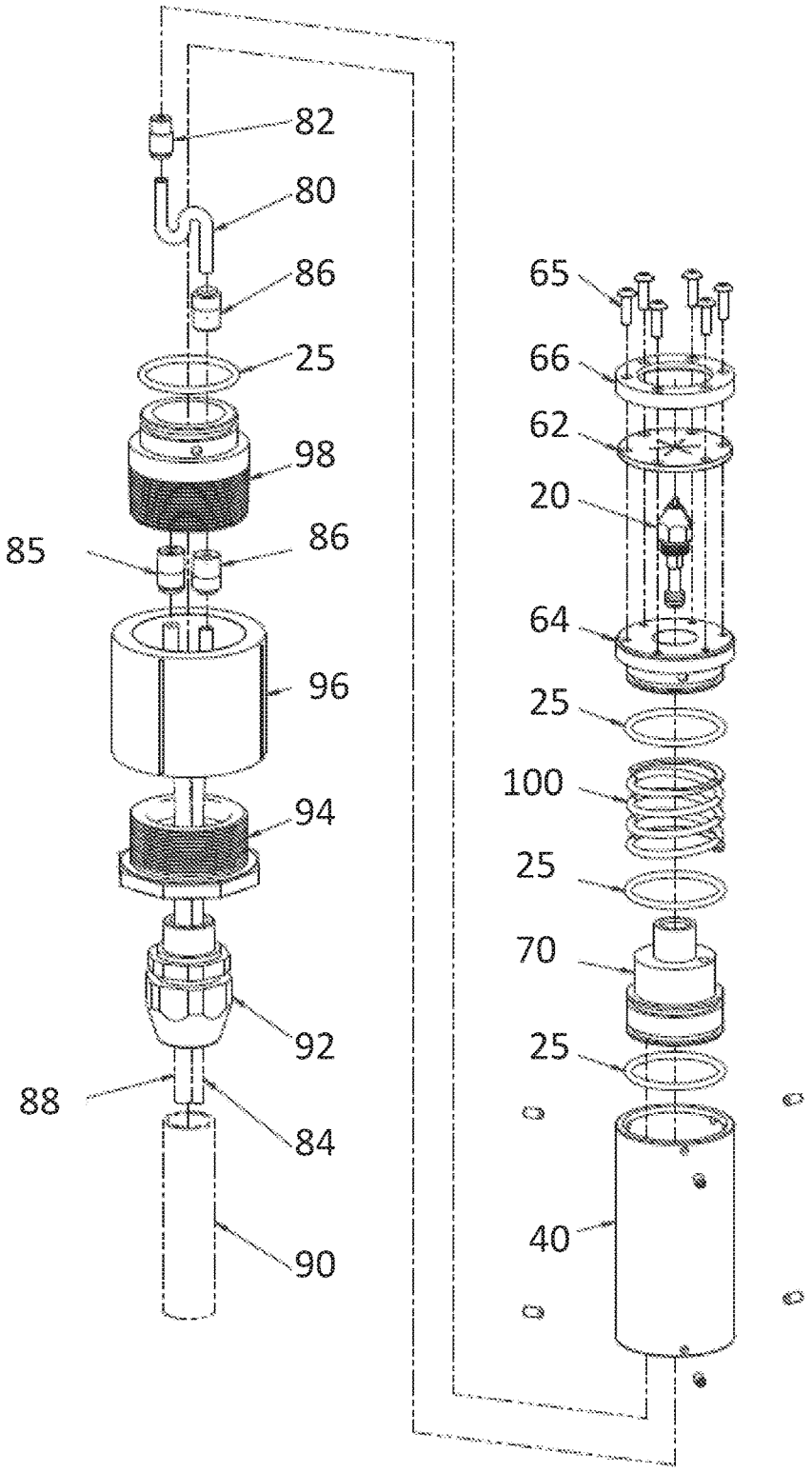
FIG. 3 is an exploded view of the components of the housing shown in FIGS. 1A-2.
Figure 4A:
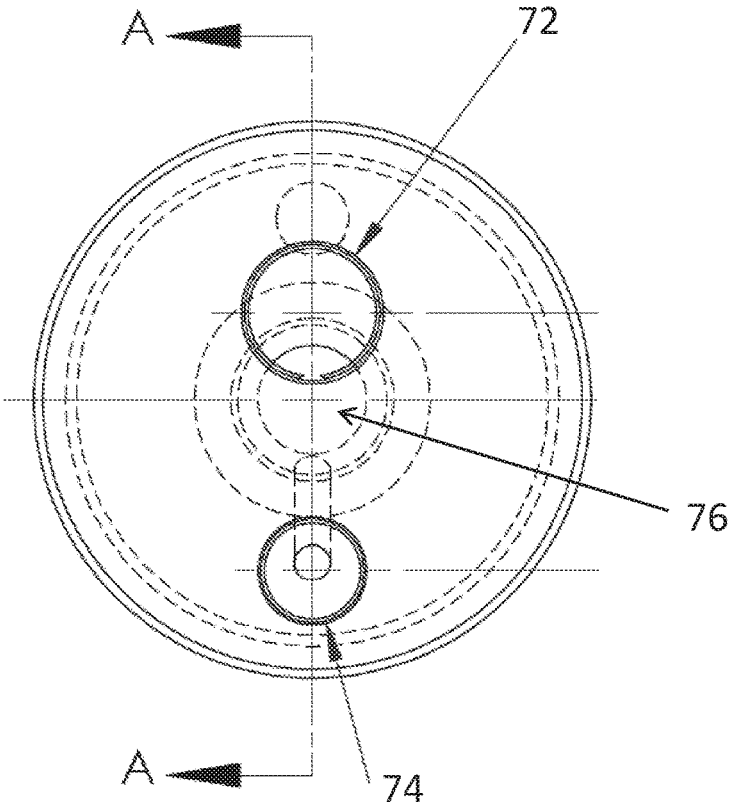
FIG. 4A is a top plan view of the piston shown in FIGS. 1A-3.
Figure 4B:
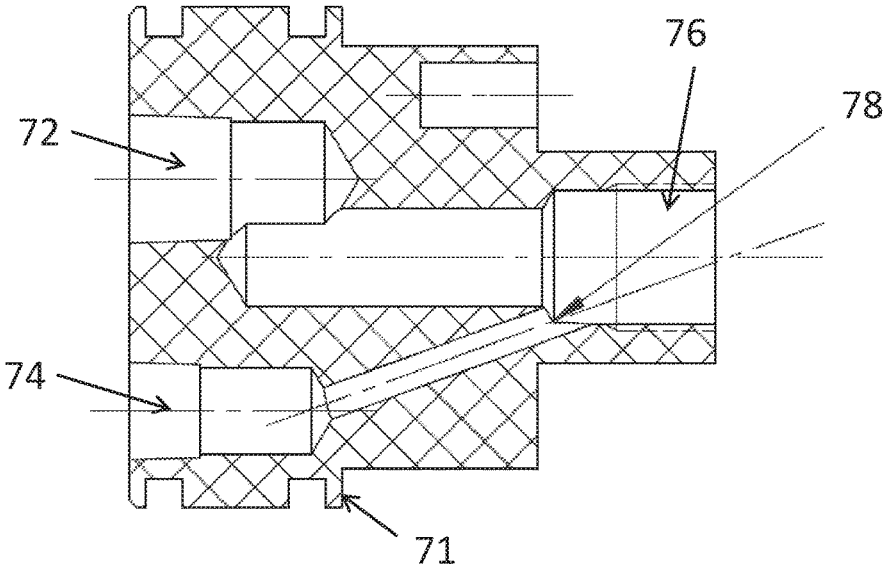
FIG. 4B is a cross sectional view of the piston shown in FIG. 4A taken along line A-A.

With reference to FIGS. 2, 3, 4A, and 4B, housing 30 also has a piston 70 that is disposed in the interior space 46 and secured to the nozzle 20. Piston 70 may include a circumferential flange 71 disposed about its perimeter. The piston 70 defines a gas inlet 72, a liquid inlet 74, and an outlet 76 fluidly connected to both the gas inlet 72 and the liquid inlet 74. As shown in FIG. 4*b*, liquid inlet 74 connects to outlet 76 via orifice 78. As shown in FIGS. 2 and 3, liquid inlet 74 connects to a tube 80 via a connector 82 to provide liquid from a system liquid line 84. System liquid line 84 connects to tube 80 via another connector 86 disposed in an adaptor cap 98. Liquid, such as water, passes through system liquid line 84 and tube 80 and into piston 70 before entering nozzle 20. Gas inlet 72 is in fluid communication with the interior space 46 of the body 40. Gas, such as compressed air, is provided to the interior space 46 via system gas line 88 that connects to the adaptor cap 98 via connector 85.

Both the system liquid line 84 and the system gas line 88 may be disposed in a flexible conduit 90. A connector 92 connects the flexible conduit 90 to an adaptor base 94 of the housing 30. Adaptor base 94 may be threaded into an adaptor body 96, which in turn mates with the adaptor cap 98.

The housing 30 further includes a biasing member 100 that fits onto the piston 70. For example, biasing member 100 may be disposed circumferentially about the body of piston 70 and abut the circumferential flange 71 of piston 70. The biasing member 100 is configured to exert a biasing force on the piston in a first direction D parallel to the axis. The biasing force of the biasing member 100 may be overcome such that the piston 70 moves in a second direction U that is opposite the first direction D. For example, biasing member 100 may be a spring, such as a stainless steel compression spring. Such a spring may have an overall length of 2 inches and a compressed length of 0.65 inches. Its spring rate may range from 40 to 50 pounds, such as between 43 and 45 pounds, and its load rate may range from 55 to 65 pounds, such as between 59 and 61 pounds.

During operation of the nozzle 20, liquid, such as water, passes through the system liquid line 84 and gas, such as compressed air, passed through the system gas line 88. The liquid and gas enter into housing 30 via connector 86 and connector 85, respectively. Liquid flows into tube 80, while gas passes into the interior space 46 of the housing 30. From tube 80, liquid flows into inlet 74 of piston 70 through to the nozzle 20. From the interior space 46, gas passes into inlet 72 of the piston 70 through to the nozzle 20 where it mixes with the liquid to form a fog. For example, nozzle 20 may be configured to mix liquid, such as water, and gas, such as compressed air, to form a dry fog formed of droplets smaller than 10 μm in size.

Prior to gas entering the interior space 46, biasing member 100 exerts a biasing force on the piston 70 in first direction D so as to bias the nozzle 20 to its retracted position such that the nozzle 20 is entirely disposed within the interior space 46. As the gas flows into the interior space 46, the gas increases the pressure within interior space 46 such that the biasing force of the biasing member 100 is overcome. As this biasing force is overcome by the pressure of the gas, the piston 70 moves in second direction U such that the nozzle 20 is disposed in its extended position. In its extended position, nozzle 20 extends through the slits 68 in the cover 62 such that at least a portion of the nozzle 20 extends past the cover assembly 60 and is positioned outside the interior space 46. In this way, the gas has at least two functions: (1) to mix with the liquid to form a fog; and (2) to actuate the nozzle 20 into its extended position.

When the liquid and gas stop flowing into the assembly 10, pressure within the interior space 46 decreases such that the biasing force of biasing member 100 is no longer overcome. Because the biasing force is no longer overcome, piston 70 moves in first direction D such that nozzle 20 returns to its retracted position. As nozzle 20 moves from its extended position to its retracted position, the edges 62*b* proximate the slits 68 scrap against the nozzle 20 thereby cleaning the nozzle. Accordingly, when the assembly 10 is not in operation, nozzle 20 is protected by cover assembly 60 from dust build-up due to exposure to its operating environment.

FIGS. 7A-8C depict assembly 101 that has a cover assembly 160 with an alternative configuration. Specifically, cover assembly 160 includes two cover plates 162*a*, 162*b* that rotate about an axis C (parallel to axis L) so as to form a gap G into which the nozzle 20 can extend in its extended position. In this configuration, plates 162*a*, 162*b* are attached to a pair of gears 164*a*, 164*b* respectively. A cam 168 is also fixed to plate 162*b*. Cam 168 includes an inclined surface 167 that mates with an inclined surface 165 of a push rod 166. Cam 168 is configured for actuation by a push rod 166 that is fixed to the piston 70.

Similar to the description outlined above in relation to FIGS. 1A-6, during operation of the nozzle, liquid, such as water, passes through the system liquid line 84 and gas, such as compressed air, passed through the system gas line 88. The liquid and gas enter into housing 30 via connector 86 and connector 85, respectively. Liquid flows into tube 80, while gas passes into the interior space 46 of the housing 30. From tube 80, liquid flows into inlet 74 of piston 70 through to the nozzle 20. From the interior space 46, gas passes into inlet 72 of the piston 70 through to the nozzle 20 where it mixes with the liquid to form a fog. For example, nozzle 20 may be configured to mix liquid, such as water, and gas, such as compressed air, to form a dry fog formed of droplets smaller than 10 μm in size.

Prior to gas entering the interior space 46, biasing member 100 exerts a biasing force on the piston 70 in first direction D so as to bias the nozzle 20 to its retracted position such that the nozzle 20 is entirely disposed within the interior space 46. Further, plates 162*a*, 162*b* are biased closed by a biasing member (not shown), such as a spring.

As the gas flows into the interior space 46, the gas increases the pressure within interior space 46 such that the biasing force of the biasing member 100 is overcome. As this biasing force is overcome by the pressure of the gas, the piston 70 moves in second direction U. As piston 70 moves in second direction U, push rod 166 also moves in second direction U, pressing its inclined surface 165 against the inclined surface 167 of cam 168. As the inclined surfaces 165, 167 slide against each other, plate 162*b* is rotated outward about axis C. Gear 164*b*, which is attached to plate 162*b*, rotates with plate 162*b*. Because gear 164*b* is meshed with gear 164*a*, which is attached to plate 162*a*, plate 162*a* also rotates outward about axis C so as to form gap G.

As piston 70 moves in second direction U, nozzle 20 also moves through gap G into its extended position. In its extended position, at least a portion of the nozzle 20 extends past the cover assembly 160 and is positioned outside the interior space 46. Thus, in conjunction with cover assembly 160, the gas has at least three functions: (1) to mix with the liquid to form a fog; (2) to actuate the plates 162*a*, 162*b* before nozzle 20 contacts plates 162*a*, 162*b*; and (3) to actuate the nozzle 20 into its extended position.

As with the configuration depicted in FIGS. 1A-6, when the liquid and gas stop flowing into the assembly 101, pressure within the interior space 46 decreases such that the biasing force of biasing member 100 is no longer overcome. Because the biasing force is no longer overcome, piston 70 moves in first direction D such that nozzle 20 returns to its retracted position. The push rod 166 also moves in direction D so that inclined surfaces 165, 167 are no longer in contact and pushing plates 162*a*, 162*b* apart. Because plates 162*a*, 162*b* are biased closed by a biasing member such as a spring, plates 162*a*, 162*b* rotate inward about axis C to their closed positions, respectively. Similar to the configuration described in relation to FIGS. 1A-6, when the assembly 101 is not in operation, nozzle 20 is protected by cover assembly 160 from dust build-up due to exposure to its operating environment.

Features of the disclosure which are described above in the context of separate embodiments may be provided in combination in a single embodiment. Conversely, various features of the disclosure that are described in the context of a single embodiment may also be provided separately or in any subcombination.

Changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the claims.

What is claimed:

1. A pneumatic assembly, the assembly comprising:

a nozzle; and a housing selectively enclosing the nozzle, the housing comprising:

a body including a first end and a second end opposite the first end, the body partially defining an interior space in which the nozzle is configured to be disposed, the body further defining a first aperture at the first end, and a second aperture at the second end, wherein the body is elongate along an axis that extends through both the first aperture and the second aperture;

a cover assembly coupled to the first end of the body that selectively blocks the first aperture and further defines the interior space;

a piston disposed in the interior space and secured to the nozzle, the piston defining a gas inlet, a liquid inlet, and an outlet fluidly connected to both the gas inlet and the liquid inlet; and a biasing member attached to the piston, the biasing member configured to exert a biasing force on the piston in a first direction parallel to the axis thereby biasing the nozzle to a retracted position in which the nozzle is entirely disposed within the interior space, the biasing member configured such that when pressurized gas flows through the second aperture of the body, the biasing force on the piston is overcome, thereby moving the piston in a second direction opposite the first direction to dispose the nozzle in an extended position in which at least a portion of the nozzle extends past the cover assembly and is positioned outside the interior space.

2. The pneumatic assembly of claim 1 wherein the nozzle is a pneumatic nozzle.

3. The pneumatic assembly of claim 2 wherein the nozzle is an ultrasonic atomizing nozzle.

4. The pneumatic assembly of claim 2 wherein the gas inlet of the piston is configured to receive the pressurized gas and wherein the gas inlet of the piston is fluidly connected to the nozzle.

5. The pneumatic nozzle assembly of claim 1 further comprising a tube that fluidly connects the liquid inlet to a fluid source, wherein the tube extends through the second aperture.

6. The pneumatic nozzle assembly of claim 1 wherein the cover assembly comprises a flexible material.

7. The pneumatic nozzle assembly of claim 6 wherein the flexible material defines at least one slit through which the nozzle extends in the extended position, the at least one slit being configured such that the flexible material proximate the at least one slit scraps against the nozzle as the nozzle moves from the extended position to the retracted position, thereby cleaning the nozzle.

8. The pneumatic nozzle assembly of claim 1 wherein the biasing member is a first biasing member and the cover assembly comprises a pair of plates and a second biasing member, such that when the nozzle is in retracted position, the second biasing member biasing the pair of plates in a closed position so as to cover the nozzle and when the nozzle is in the extended position, the nozzle extends through a gap defined by the pair of plates.

9. The pneumatic nozzle assembly of claim 8 wherein the first and second biasing members are springs.

10. A housing for a pneumatic nozzle, the housing comprising:

a body including a first end and a second end opposite the first end, the body partially defining an interior space in which the nozzle is configured to be disposed, the body further defining a first aperture at the first end, and a second aperture at the second end, wherein the body is elongate along an axis that extends through both the first aperture and the second aperture;

a cover assembly coupled to the first end of the body such that the cover assembly selectively blocks the first aperture and further defines the interior space;

a piston disposed in the interior space and secured to the nozzle, the piston defining a gas inlet, a liquid inlet, and an outlet fluidly connected to both the gas inlet and the liquid inlet; and a biasing member attached to the piston, the biasing member configured to exert a biasing force on the piston in a first direction parallel to the axis so as to bias the nozzle to a retracted position in which the nozzle is entirely disposed within the interior space, the biasing member configured such that when pressurized gas flows through the second aperture of the body, the biasing force on the piston is overcome, thereby moving the piston in a second direction opposite the first direction to dispose the nozzle in an extended position in which at least a portion of the nozzle extends past the cover assembly and is positioned outside the interior space.

11. The housing of claim 10 wherein the biasing member is a spring.

12. The housing of claim 10 wherein the cover assembly comprises a flexible material.

13. The housing of claim 12 wherein the flexible material defines at least one slit through which the nozzle extends in the extended position, the at least one slit being configured such that the flexible material proximate the at least one slit scraps against the nozzle as the nozzle moves from the extended position to the retracted position, thereby cleaning the nozzle.

14. The housing of claim 10 wherein the biasing member is a first biasing member and the cover assembly comprises a pair of plates and a second biasing member, such that when the nozzle is in retracted position, the second biasing member biasing the pair of plates in a closed position so as to cover the nozzle and when the nozzle is in the extended position, the nozzle extends through a gap defined by the pair of plates.

15. The housing of claim 14 wherein the first and second biasing members are springs.

16. A method for protecting a pneumatic nozzle during non-operational periods using a housing configured to protect the pneumatic nozzle, wherein the housing comprises a body including a first end and a second end opposite the first end, the body partially defining an interior space in which the nozzle is configured to be disposed, the body further defining a first aperture at the first end, and a second aperture at the second end, wherein the body is elongate along an axis that extends through both the first aperture and the second aperture; a cover assembly coupled to the first end of the body such that the cover assembly selectively blocks the first aperture and further defines the interior space; a piston disposed in the interior space and secured to the pneumatic nozzle; and a biasing member attached to the piston, the method comprising:

exerting a biasing force on the piston in a first direction parallel to the axis so as to bias the nozzle to a retracted position in which the nozzle is entirely disposed within the interior space;

overcoming the biasing force on the piston by flowing pressurized gas through the second aperture of the body; and moving the piston in a second direction opposite the first direction to dispose the nozzle in an extended position in which at least a portion of the nozzle extends past the cover assembly and is positioned outside the interior space.

17. The method of claim 16 further comprising a step of mixing the pressurized gas with a liquid so as to form liquid droplets.

18. The method of claim 17 wherein the step of mixing comprises forming droplets smaller than 10 μm in size.

19. The method of claim 16 wherein the cover assembly comprises a flexible material that defines at least one slit and the method further comprises a step of cleaning the pneumatic nozzle by scraping the flexible material proximate the at least one slit against the nozzle as the nozzle moves from the extended position to the retracted position.

20. The housing of claim 10 wherein the biasing member is a first biasing member and the cover assembly comprises a pair of plates and a second biasing member, and the step of moving the piston in the second direction comprises overcoming a biasing force exerted by the second biasing member so as to open the pair of plates.

* * * * *